US007340190B2

(12) United States Patent
Toyohara et al.

(10) Patent No.: US 7,340,190 B2
(45) Date of Patent: Mar. 4, 2008

(54) IMAGE FORMING APPARATUS

(75) Inventors: Yuichiro Toyohara, Fujisawa (JP); Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/694,047

(22) Filed: Mar. 30, 2007

(65) Prior Publication Data

US 2007/0166086 A1 Jul. 19, 2007

Related U.S. Application Data

(62) Division of application No. 11/088,846, filed on Mar. 25, 2005.

(30) Foreign Application Priority Data

Mar. 29, 2004 (JP) ..... 2004-096921
Mar. 24, 2005 (JP) ..... 2005-087109

(51) Int. Cl.
*G03G 15/00* (2006.01)
*G03G 15/20* (2006.01)

(52) U.S. Cl. ..... 399/45; 399/341

(58) Field of Classification Search ..... 399/45, 399/341

See application file for complete search history.

(56) References Cited

U.S. PATENT DOCUMENTS 5,671,462 A 9/1997 Toyohara et al. ..... 399/33
5,987,275 A 11/1999 Toyohara et al. ..... 399/70
6,049,681 A 4/2000 Shiozawa et al. ..... 399/46
6,385,426 B1 5/2002 Kimura et al. ..... 399/302
6,442,356 B2 8/2002 Omata et al. ..... 399/66
6,529,693 B2 * 3/2003 Tomizawa et al. ..... 399/45 X
6,608,641 B1 * 8/2003 Alexandrovich et al. . 399/45 X
7,013,105 B2 3/2006 Omata ..... 399/296
2002/0098022 A1 * 7/2002 Kabashima ..... 399/341
2003/0206758 A1 * 11/2003 Yasui et al. ..... 399/329

FOREIGN PATENT DOCUMENTS

JP 11-231562 8/1999
JP 2001-337496 12/2001
JP 2002-125129 4/2002
JP 2003-5419 1/2003
JP 2004-88232 3/2004

* cited by examiner

*Primary Examiner*—David M. Gray
*Assistant Examiner*—Erika J. Villaluna
(74) *Attorney, Agent, or Firm*—Fitzpatrick, Cella, Harper & Scinto

(57) ABSTRACT

In an image forming apparatus, an image forming condition is changed depending on whether or not a recording material on which a toner image is formed is ordinary high gloss paper or thermoplastic resin coated paper. More specifically, in the case where a high gloss mode is selected during image formation, judgement whether or not the high gloss paper is the ordinary high gloss paper or the thermoplastic resin coated paper is made. In the former case, a screen line number is set to 150 lpi, and in the latter case, the screen line number is set to 200 lpi. As a result, image failure due to collapse of a toner layer (during fixation) on the ordinary high gloss paper is prevented and high-quality toner image is formed on the thermoplastic resin coated paper.

8 Claims, 13 Drawing Sheets

| LOW GLOSS MODE | MEDIUM GLOSS MODE | HIGH GLOSS MODE |
|---|---|---|
| 200mm/sec | 100mm/sec | 70mm/sec |
FIG.2
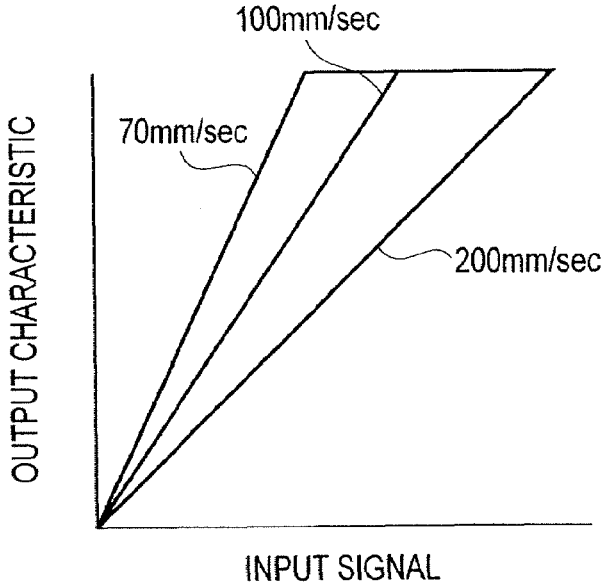
FIG.3
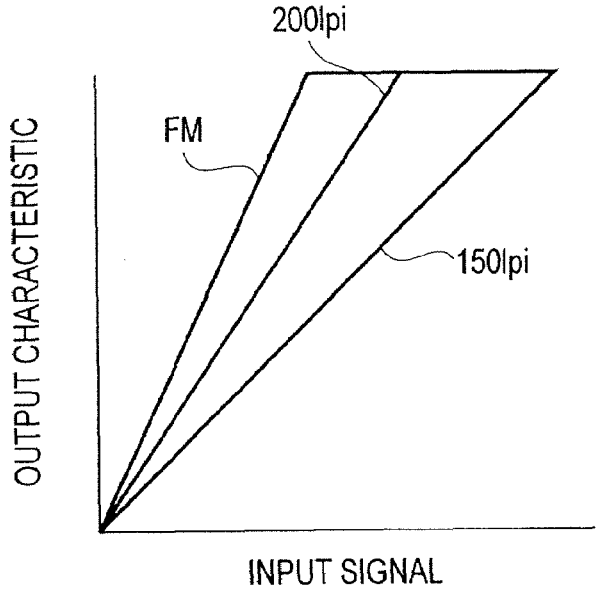
FIG.4

IMAGE FORMING APPARATUS

This application is a divisional of U.S. patent application Ser. No. 11/088,846, filed Mar. 25, 2005.

FIELD OF THE INVENTION AND RELATED ART

The present invention relates to an image forming apparatus using electrophotography, particularly an image forming apparatus such as a copying machine, a printer, a facsimile apparatus, etc.

In an image forming apparatus, in which image formation is performed with toner, such as a copying machine, a printer, a facsimile apparatus, etc., demand for image formation on not only bond paper as a recording material (toner-receiving paper) but also high gloss paper such as coated paper or the like, has been increased. This is because such high gloss paper is used for printing with ink or photographic printing.

For this reason, in recent years, image forming apparatuses which have a high gloss mode and are capable of giving a high gloss corresponding to the high gloss paper have been increasingly commercialized. Generally, in the high gloss mode, compared with a case where a toner image is fixed on bond paper or the like, a toner layer is reliably melted by decreasing a fixing speed to be flattened on the surface of the bond paper, thus giving a high gloss.

On the other hand, with respect to the recording material, there is a trend such that special-purpose paper is developed in order to obtain a beautiful glossy image comparable to silver halide photography as described in Japanese Laid-Open Patent Application (JP-A) No. 2003-005419.

As described above, through development from the viewpoints of both of the image forming apparatus and the recording material, it has become possible to output a high gloss image on high gloss paper.

However, in such a method that image formation is effected on ordinary resin coated paper or the like for printing by controlling a fixing speed, there arises the following problem.

As shown in FIG. 9, when a toner image (toner layer) t is stepwise fixed on a recording material P, on a smooth (flat) toner layer surface, light A1 is regularly reflected as light A2 but at a stepwise portion, light A3 is irregularly reflected as light A4. In other words, a regular reflection component of the light A3 is blocked at the stepwise portion to be deteriorated in gloss characteristic. Accordingly, in the case where image processing of halftone having a screen structure is performed according to an area coverage modulation, when an image is formed on glossy paper having a glossiness of 40 degrees, such a gloss characteristic as shown in FIG. 10 that a gloss is smallest at the halftone portion. Such a state is referred herein to as a "state A".

Therefore, it is preferable that the gloss characteristics is improved by reducing the stepwise portion (by lowering a height thereof) by flattening the toner layer t.

In this case, however, there arises such a problem that a noise due to a decrease in height of the toner layer t is caused to occur. When the toner image is fixed by the above method, the toner layer t is flattened to decrease and smoothen the stepwise portion, so that the gloss characteristic is changed to a substantially ideal gloss characteristic indicated by a solid line in FIG. 11 when attention is paid only to the gloss characteristic. However, on the other hand, when the resultant graininess is compared with that in the above described state A, it is considerably worsen. Such a state is referred to as a "state B".

FIG. 12 is a graph showing a relationship between the gloss characteristic and the graininess with respect to the states A and B. The reason why the graininess in the state B is worsen may be that a spreading manner of toner when the toner layer is flattened or collapsed to be spread is affected by a difference in height of the toner layer t, a subtle difference in pressure during the fixation, a subtle difference in thickness of the recording material P, and the like, thus resulting in nonuniform one.

When such a phenomenon is caused to occur, dot gain of the toner image is increased and as shown in FIG. 13, a γ characteristic in the state B is shifted to a higher γ characteristic side when compared with that in the state A. In the state B, there arise problems of not only the higher γ characteristic and the worsening of graininess but also collapse of character and worsening of stability in terms of image qualities. In FIG. 13, the γ characteristic is approximately indicated by a straight line.

On the other hand, when a toner image is formed on a recording material having a toner receiving layer formed of a thermoplastic resin as described in JP-A No. 2003-005419, the toner layer is flattened under pressure at the time of fixation but the toner receiving layer blocks spreading of the toner layer in a longitudinal direction of the recording material. As a result, the toner image can be fixed without being so spread.

As described above, depending on the kind of glossy paper, an image quality after fixation is largely changed.

SUMMARY OF THE INVENTION

An object of the present invention is to provide an image forming apparatus capable of improving a gloss characteristic of an image while suppressing a lowering in image quality.

This and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 2 is a view showing fixing speeds in a low gloss mode, a medium gloss mode, and a high gloss mode.

FIG. 3 is a graph showing a relationship between a fixing speed and a γ (gamma) characteristic with respect to ordinary high gloss coated paper.

FIG. 4 is a graph showing a relationship between a screen line number and a γ characteristic with respect to ordinary high gloss coated paper.

DETAILED DESCRIPTION OF THE PREFERRED EMBODIMENTS

Figure 1:
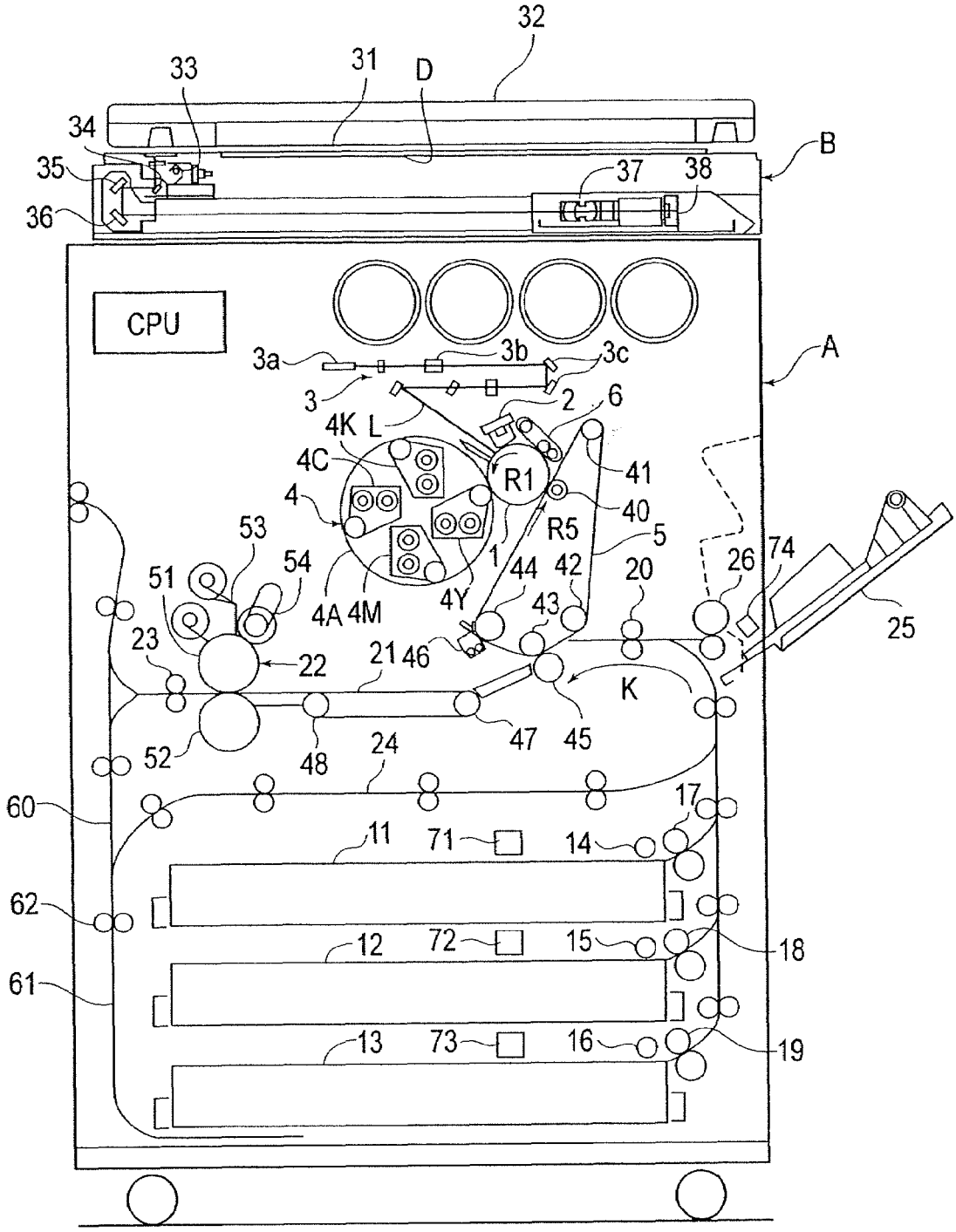
FIG. 1 is a schematic longitudinal sectional view showing an image forming apparatus.

Hereinbelow, embodiments of the present invention will be described with reference to the drawings.

In the drawings, members or means represented by identical reference numerals have the same constitutions or functions, thus being appropriately omitted from repetitive explanations.

Embodiment 1

FIG. 1 shows an example of an image forming apparatus to which the present invention is applicable. The image forming apparatus is a four-color-based full color printer according to electrophotography. FIG. 1 is a schematic longitudinal sectional view showing a general structure of the color printer.

(Structure of Image Forming Apparatus)

The printer shown in FIG. 1 (image forming apparatus) includes a digital color image printer portion A and a digital color image reader portion B disposed on an upper surface of the printer portion.

At the printer portion A, a drum-type electrophotographic photosensitive member 1 as an image bearing member (hereinafter referred to as a "photosensitive drum") is disposed rotatably in a direction of an arrow R1. Around the photosensitive drum 1, a primary charger 2 as a charging means, a laser exposure optical system 3 as an exposure means, a developing apparatus 4 as a developing means, an intermediary transfer belt 5 as an intermediary transfer member, a cleaning apparatus 6 as a cleaning means, etc., are disposed substantially in this order in a rotational direction of the photosensitive drum 1. The developing apparatus 4 includes a rotatably rotary member 4A and four developing devices, mounted thereon, consisting of developers 4Y, 4M, 4C and 4K of yellow (Y), magenta (M), cyan (C) and black (K), respectively. The intermediary transfer belt 5 is extended around a drive roller 41, tension rollers 42 and 44, and a secondary transfer opposite roller 43. Inside the intermediary transfer belt 5, a primary transfer roller 40 for pressing the intermediary transfer belt 5 against the photosensitive drum 1 is disposed. Outside the intermediary transfer belt 5, a secondary transfer roller 45 is disposed at a position opposite to the secondary transfer opposite roller 43. At a lower portion of the printer portion A, paper feeding cassettes 11, 12, 13; paper feeding rollers 14, 15, 16; conveyance rollers 17, 18, 19; registration rollers 20; a conveyance belt 21 extended around rollers 47 and 48; a fixation apparatus 22 as a fixing means; and a delivery (paper discharge) roller 23 are disposed in this order from an upstream side of a conveyance direction of a recording material P (in a direction of an arrow K). The fixation apparatus 22 includes a fixation roller cleaner 53. Further, the image forming apparatus includes a double-sided conveyance path 24, a manual feed tray 25, and a paper feed roller 26.

The reader portion B includes an original supporting glass plate 31; an original pressing plate 32; an exposure lamp 33; reflection mirrors 34, 35 and 36; a lens 37; a full-color CCD sensor 38, etc.

In the above structured image forming apparatus, during image formation, at the reader portion B, an original D is placed on the original supporting glass plate 31 in such a state that an image surface thereof is directed downward, and is pressed by the original pressing plate 32. Exposure scanning with the exposure lamp 33 is performed at the image surface of the original D, and an image of light reflected by the original D surface is concentrated into the full-color CCD sensor 38 to obtain a color separation image signal. The color separation image signal is subjected to image processing by a video-processing unit (not shown) through an amplifying circuit (not shown) and sent to the printer portion A through an image memory (not shown).

To the printer portion A, other than the signal from the reader portion B, an image signal from a computer as external equipment and an image signal from a facsimile apparatus are also similarly sent.

Here, on the basis of the signal from the reader portion B as a representative signal, an operation of the printer portion A will be described below.

During the image formation, the photosensitive drum 1 is rotationally driven by a drive means (not shown) in a direction of the arrow R1 at a predetermined process speed (peripheral speed), and the surface of the photosensitive drum 1 is electrically charged uniformly to a predetermined polarity and a predetermined potential by the primary charger 2.

On the surface of the photosensitive drum 1 after the charging, an electrostatic latent image is formed by the laser exposure optical system 3. An image signal from the reader portion B is converted into an optical signal by a laser output portion (not shown) and laser light converted into the optical signal is reflected by a polygon mirror 3*a* and incident on the charged surface of the photosensitive drum 1 through a lens 3*b* and respective reflection mirrors 3*c*. As a result, electric charges at the exposure (irradiation) portion are removed, whereby, e.g., a first yellow electrostatic latent image is formed.

The electrostatic latent image is developed as an yellow toner image by the yellow developing device 4Y which is moved to a developing position opposite to the photosensitive drum 1 by the rotation of the rotary member 4A. Incidentally, the toner principally comprises a resin and a pigment. The toner contained in the yellow developing device 4Y is successively supplied from a toner containing portion (not shown) so that a toner rate (amount) in the developing device 4Y becomes constant.

Then, the yellow toner image formed on the photosensitive drum 1 is primary-transferred onto the intermediary transfer belt 5 by the primary transfer roller 40. Residual toner remaining on the surface of the photosensitive drum 1 after the toner image transfer is removed by the cleaning apparatus 6, and the photosensitive drum 1 is subjected to image formation on a subsequent color (e.g., magenta as a second color).

The above described respective image formation processes comprising transfer, and cleaning, which have been performed with respect to the yellow toner image are similarly repetitively performed with respect to other toner images of three colors of magenta, cyan and black. As a result, four color toner images are superposed on the intermediary transfer belt 5.

The superposed four color toner images on the intermediary transfer belt 5 as described above are secondary-transferred onto the recording material P at the same time. The recording material P which is, e.g., contained in the paper feeding cassette 11 is supplied to a secondary transfer portion between the intermediary transfer belt 5 and the secondary transfer roller 45, while being timed with movement of the resultant toner image on the intermediary transfer belt 5, by the paper feed roller 14, the conveyance roller 17, the registration rollers 20, etc. Residual toner remaining on the surface of the intermediary transfer belt 5 after the toner image transfer is removed by a belt cleaner 46 and the intermediary transfer belt 5 is subjected to subsequent primary transfer.

On the other hand, the recording material P after the toner image transfer is conveyed to the fixation apparatus 22 by the conveyance belt 21 and, in the fixation apparatus 22, is conveyed to a fixation nip portion between the fixation roller 51 and the pressure roller 52 pressed against the fixation roller 51. As a result, the toner image is fixed on the surface of the recording material P at the nip portion under heat and pressure.

A CPU (FIG. 1) as the control means controls energization of a halogen heater contained in the fixation roller 51 so that a surface temperature of the fixation roller 51 is kept at a predetermined fixation temperature (approximately 180° C.). In this case, a temperature detection element for detecting the surface temperature of the fixation roller 51 is disposed, and the CPU controls energization of the halogen heater depending on a signal from the temperature detection element.

The fixation apparatus 22 is constituted by the fixation roller 51 and the pressure roller 52, so that a temperature at which the recording material is separated from the fixation apparatus 22 (fixation roller 51) is substantially the fixation temperature (180° C.)

In this embodiment, the fixation roller 51 has no surface rubber layer but is surface-coated with a fluorine-based resin tube, so that the life of the fixation roller 51 is prolonged.

The recording material P after the toner image fixation is discharged on a discharge (delivery) tray (not shown) by the discharge roller 23. As a result, image formation on one surface of the recording material P is completed.

In this embodiment, the fixation roller 51 has no surface rubber layer but is surface-coated with a fluorine-based resin tube, so that the life of the fixation roller 51 is prolonged.

The recording material P after the toner image fixation is discharged on a discharge (delivery) tray (not shown) by the discharge roller 23. As a result, image formation on one surface of the recording material P is completed.

In the case where double-sided image formation on the recording material P is performed, immediately after the recording material P passes through the fixation apparatus 22, a conveyance pass guide (not shown) is driven to once guide the recording material P to an inversion pass 61 through a conveyance pass 60. Thereafter, the recording material P is sent to a double-sided conveyance path 24 by reverse rotation of a reverse rotation roller 62 with a trailing end at the time of conveyance as a leading end in a direction opposite to the (previous) conveyance direction.

Thereafter, the recording material P passes through the double-sided conveyance path 24 and is subjected to oblique movement correction and timing adjustment, thus being conveyed between the registration rollers 20 at desired timing. Then, a toner image is formed on the other surface of the recording material P through again the above described image formation processes, followed by fixation to complete the image formation on double-sided surfaces of the recording material P.

In this embodiment, recording material glossiness detection apparatuses 71, 72, 73 and 74 are disposed at positions corresponding to positions of the respective paper feeding cassettes 14, 15 and 16 and the manually paper feeding tray 25, respectively, to detect glossiness of the recording material P which is subjected to image formation. The resultant detection result is fed back to an image forming condition described later. By doing so, it is possible to optimize an image quality depending on the recording material P used.

Here, the recording material P usable in this embodiment will be described.

As a kind of the recording material, it is possible to employ those of various types but may be roughly classified into three types including low gloss paper represented by high-quality paper, medium gloss paper represented by A2 coated paper (which comprises duodecimo high-quality paper on both surfaces of which are coated with 20 g in total of paint is coated, and high gloss paper represented by cast coated paper or, e.g., media on which a toner-receiving layer (thermoplastic resin layer) is coated. Control is made so that a glossiness is reproduced in correspondence with each of the recording materials P. Characteristics are largely different between ordinary coated paper, such as the above described A2 coated paper or cast coated paper, which is not melted in the neighbourhood of the fixation temperature (180° C.), and spatial-purpose coated paper such that the above described toner-receiving layer (thermoplastic resin layer) having a melting characteristic that it is melted at a temperature in the neighbourhood of the fixation temperature is coated.

More specifically, the recording material P meeting the high gloss mode is roughly classified into two kinds thereof including the above described ordinary coated paper and toner-receiving paper having the toner-receiving layer formed of thermoplastic resin (hereinafter referred to as "thermoplastic resin coated paper"). However3, in the cases where image formation is performed on these recording materials P under the same image formation condition, there arise the following problems.

The ordinary high gloss coated paper is liable to readily diffuse in a horizontal direction (along the surface of the recording material P), thus being more liable to cause abrupt γ characteristic. Particularly, in the case where a screen line number at the time of halftone treatment in area coverage modulation or where such a halftone treatment that a peripheral length of pixel becomes long as in frequency modulation (FM) mode, abrupt γ characteristic is more liable to occur.

On the other hand, the thermoplastic resin coated paper is suppressed in movement of the toner layer in the horizontal direction of the toner-receiving layer, thus being less liable to have a higher gamma compared with the ordinary high gloss coated paper.

Figure 5:
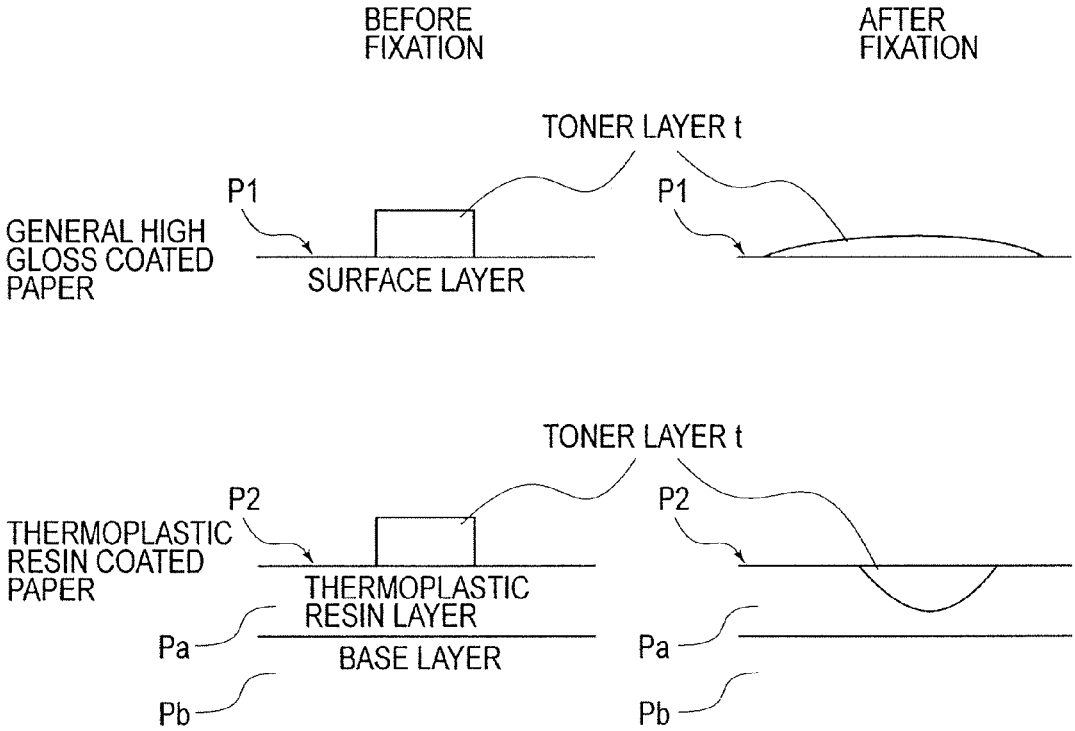
FIG. 5 includes views showing states of toner layers before and after fixation with respect to ordinary high gloss coated paper and thermoplastic resin coated paper.

FIG. 5 includes views schematically showing states of toner layers t at the time of fixation with respect to the ordinary high gloss coated paper P1 and the thermoplastic resin coated paper P2. The toner layers t before the fixation are the same in both of the cases of the ordinary high gloss coated paper P1 and the thermoplastic resin coated paper P2. On the other hand, after the fixation, the toner layer t of the ordinary high gloss coated paper P1 is a surface layer rob the recording material but that the thermoplastic resin coated paper P2 enters a toner-receiving layer Pa of thermoplastic resin coated on a recording material supporting layer Pb, so that such a phenomenon that the toner layer t is collapsed to be extended as described above is not caused to occur. For this reason, as described above, the thermoplastic resin coated paper P2 is less liable to provide the abrupt γ characteristic.

Further, such an amount that the toner layer t is collapsed and extended correlates with a length of the toner layer t at an end portion thereof. A large number of lines of the toner layer t provides a large increment of hiding rate, so that the resultant γ characteristic becomes abrupt.

On the other hand, in the case of the thermoplastic resin coated paper, the toner layer t is melted into the toner-receiving layer during fixation, so that such a phenomenon that it is collapsed and extended as described above is not readily caused to occur. Accordingly, when the γ characteristic of the thermoplastic resin coated paper is compared with that of the ordinary high gloss coated paper at the time when it is subjected to halftone treatment in FM mode and fixation, the γ characteristic of the thermoplastic resin coated paper is substantially identical to that of the ordinary high gloss coated paper providing 150 lpi (line per inch).

In this embodiment, as described later, the halftone treatment is performed in FM mode at the time when image formation on the thermoplastic resin coated paper is performed in the high gloss mode. In this present invention, however, it is possible to adopt any treatment so long as it provides a γ characteristic between the FM mode providing 200 lpi or the like and AM 150 lpi. As described above, image formation is effected through such a halftone treatment that a total peripheral length of pixel per unit area is longer than that of the ordinary high gloss coated paper used in the high gloss mode, whereby a high gloss characteristic can be realized and screen lines are less visible. As a result, it becomes possible to output a higher quality image such that it is possible to reproduce an image close to a photographic image and to provide a higher resolution.

Hereinafter, the constitution of the coated paper used in the high gloss mode will be explained more specifically.

(Ordinary Coated Paper)

The ordinary coated paper such as the above described A2 coated paper or cost coated paper, which is not melted at approximately fixation temperature (180° C.), will be described.

Such coated paper is subjected to coating of a layer which is called a pigment coating layer. The pigment coating layer is used for improving a printing quality, thus considerably improving a smoothness, an ink receptive performance, glossiness, whiteness, and opacity.

More specifically, on at least one surface of general high-quality paper as the supporting member, a coating liquid principally comprising a pigment and an aqueous binder is coated to form a pigment coating layer, which is then subjected to smoothing treatment. As the pigment, it is possible to use mineral pigments, such as calcium carbonate heavy, precipitated calcium carbonate light, kaolin, calcined kaolin, constitutive kaolin, delamikaolin, talc, calcium sulphate, barium sulfate, titanium dioxide, zinc oxide, alumina, magnesium carbonate, magnesium oxide, silica, magnesium aluminosilicate, fine-grain calcium silicate, fine-grain magnesium silicate, fine-grain precipitated calcium carbonate light, white carbon, bentonite, zeolite, sericite, smectite, etc.; resins, such as polystyrene, styrene-acrylic copolymer, urea resin, melamine resin, acrylic resin, vinylidene chloride resin, and benzoguanamine resin; minute hollow particles of these resins; and through-hole type organic pigments. These pigments may be used singly or in combination of two or more species.

As the aqueous binder, it is possible to use a water-soluble or water-dispersible polymeric compound. Examples thereof may include: starches, such as cationic starch, amphoteric starch, starch oxide, enzyme-modified starch, thermochemical-modified starch, and esterified starch; cellulose derivatives, such as carboxymethyl cellulose and hydroxyethyl cellulose; natural or semisynthetic polymeric compounds, such as gelatine, casin, soy protein, and natural rubber; polydienes, such as polyvinyl alcohol, isoprene, neoprene, and polybutadiene; polyalkenes, such as polybutene, polyisobutyrene, polypropylene, and polyethylene, polymers or copolymers of vinyl esters, such as vinyl halide, vinyl acetic acid, styrene, (meth-)acrylic acid, (meth-)acrylate, (meth-)acryloamide, and methylvinyl ether; and synthetic rubber latexes, such as styrene-butadiene rubber latex and methacrylate-butadiene rubber latex; synthetic polymeric compounds, such as polyurethane, polyester, polyamide, olefin-maleic anhydride resin, and melamine resin. These binders may be appropriately used singly or in combination of two or more species depending on a target quality of an electrophotographic transfer sheet.

In the coating liquid for the pigment coating layer, it is also possible to further add other additives, such as a surfactant, a PH adjusting agent, a viscosity adjusting agent, a softening agent, a gloss-imparting agent, a wax, a dispersing agent, a flowability modifying agent, an anti-static agent, a stabilizer, a charge-preventing agent, a crosslinking agent, a sizing agent, fluorescent brightening agent, a colorant, an ultraviolet absorber, an antifoaming agent, a water resistant additive, a plasticizer, a lubricant, an antiseptic, and a perfume.

A coating amount of the pigment coating layer may appropriately selected depending on intended purpose. However, the coating amount is required to be such an amount that it can completely cover an unevenness of the supporting member surface and may preferably be 8-40 $g/m^2$ after drying. In order to coat the coating layer, it is possible to appropriately use a known coating apparatus, such as a blade coater, an air knife coater, a roll coater, a reverse roll coater, a bar coater, a curtain coater, a die coater, a gravure coater, Champlex coater, a brush coater, a size press coater of a two roll type or a metering blade type, Billbrade coater, a short dwell coater, or a gate roll coater.

The pigment coating layer is formed on one or both surfaces of the supporting member and may have a multi-layer structure including one or two or more intermediary transfer layers. In the case of the double-sided coating or the multi-layer structure, each coating liquid is not required to be identical in kind or amount but may only be required to be appropriately formulated depending on a desired quality level. In the case of forming the coating layer on one surface of the supporting member, it is also possible to form a synthetic resin layer, a coating layer comprising a pigment and an adhesive or the like, and an anti-static layer on the other surface thereof to impart a carl prevention function, printability, suitability for paper feed/discharge, etc. Further, it is also possible to impart various use suitabilities by effecting various processings or treatments, at the back surface of the supporting member, such as post-processings for providing various characteristics including adhesiveness, magnetic property, fire retardance, heat resistance, resistance to water, resistance to oil, rust prevention property, etc.

When the supporting material is subjected to the smoothing treatment, an ordinary apparatus for smoothing treatment such as super calendar, gloss calendar, soft calender, etc., is used. Further, the smoothing treatment may be appropriately performed in an on- or off-machine manner. Further, a shape of a pressing apparatus, the number of pressure nips, and a heating condition may appropriately controlled depending on those for the ordinary smoothing treatment apparatus.

With respect to such coated paper, the pigment coating layer is not melted at a temperature close to the fixation temperature and a gloss is not substantially changed.

As such coated paper, there have been known those including cast coated paper (Model "NS701", "NS1000", mfd. by Canon K.K.), coated paper ("OK Topcoat", SA Kinfuji", mfd. by Oji Paper Co., Ltd.), and coated paper ("4CC Art Sheets", mfd. by Stora Enso).

(Coated Paper Provided with Toner Receptive Layer)

Special-purpose coated paper provided with a thermoplastic resin layer as a toner receptive layer having such a melt characteristic that it is melted at a temperature close to a fixation temperature (180° C.) will be described. This coated paper is prepared by forming about 20 micron-thick toner receptive layer (on which a toner image is transferred and fixed) of polyester resin on both surfaces of a sheet-like supporting member (e.g., a supporting layer of high-quality paper). This is because it has been experimentally confirmed that the thickness of 20 microns is preferable when toner particles used have an average particle size of about 5 microns. However, such a preferable thickness varies depending on a condition, so that the thickness may be appropriately set depending on the condition.

The above prepared coated paper is characterized in that the outermost surface layer as the toner receptive layer is melted at the temperature close to the fixation temperature. As a result, when a toner image is fixed on the recording material, the toner image is embedded in the toner receptive layer, thus reducing the stepwise portion by the toner as described above.

As a specific production example of the coated paper, a transparent resin layer is formed on the pigment coating layer of the coated paper. As a result, it is unnecessary to mix a pigment in an outermost resin layer since the lower layer is the pigment layer and has a highly white smooth surface, so that a function of increasing whiteness is not required. For this reason, the surface thermoplastic transparent resin layer can be designed so that a high priority is given to a function of embedding the toner image. Further, there is also such an advantage that it is not necessary to newly produce coated paper.

As such recording material, coated paper ("POD super gloss coated paper", mfd. by Oji Paper Co., Ltd.) has been commercialized.

In a specific production method of the coated paper, desired coated paper can be produced by coating one surface or both surface of coated paper, comprising a supporting member and the above described pigment coating layer thereon as base paper, with thermoplastic resin by the gravure coater or the like. As a resin constituting the transparent resin layer, it is possible to use polyester resin, styrene-acrylate resin, and styrene-methacrylate resin, particularly preferably polyester resin. The polyester resin may be constituted by a polyhydric alcohol component and a polybasic carboxylic acid component.

Examples of the polyhydric alcohol component may include: ethylene glycol; propylene glycol; 1,4-butanediol; 2,3-butanediol; diethylene glycol; triethylene glycol; 1,5-pentanediol; 1,6-hexanediol; neopentyl glycol; 1,4-cyclohexane dimethanol; dipropylene glycol; polyethylene glycol; polypropylene glycol; and a monomer obtained by adding olefin oxide to bisphenol A.

Examples of the polybasic carboxylic acid may include: maleic acid; maleic anhydride; fumaric acid; phthalic acid; terephthalic acid; isophthalic acid; malonic acid; succinic acid; glutaric acid; n-dodecylsuccinic acid; 1,2,4-benzenetricarboxylic acid; 1,2,4-cyclohexanetricarboxylic acid; 1,2,4-naphthalenetricarboxylic acid; 1,2,5-hexane-tricarboxylic acid; 1,3-dicarboxy-2-methyl-2-methylenecarboxy propane; tetra(methylenecarboxy)methane; 1,2,7,8-octanetetracarboxylic acid, trimellitic acid; pyromellitic acid; and lower alkyl esters of these components.

The polyester resin constituting the transparent resin layer is synthesized through polymerization of at least one species of the above described polyhydric alcohol component and at least one species of the above described polybasic carboxylic acid component. As the resin component of the toner, polyester resin is principally used for color toner and styrene-acrylic resin is principally used for monochromatic toner, so that it is preferable that a resin having a high mutual solubility to the toner as the thermoplastic resin constituting the transparent resin layer. More specifically, one species of or a mixture of two or more species of resins selected from the group consisting of polyester resin, styrene-acrylate resin, and styrene-methacrylate resin is used depending on the purpose of the recording material.

In the transparent resin layer, it is possible to add a pigment, a release agent, an electroconductivity-imparting agent within the limits of not hindering its transparency. In that case, an amount of the resin as a principal component may preferably be not less than 80% per the entire resin layer. Further, the transparent resin layer may preferably be adjusted to have a surface electric resistance of not less than $8.0\times10^8$ ohm at a temperature of 20° C. and a relative humidity of 85%.

The production process of the above described coated paper is not limited to that described above. The coated paper is not necessarily formed in the multi-layer structure but may further contain various additives such as a pigment so long as the coated paper has a thermoplastic resin layer having such a melt characteristic that the surface layer component is melted at the temperature close to the fixation temperature.

Next, the melt characteristic of the resin constituting the toner receptive layer at the temperature close to the fixation temperature will be described.

The melt characteristic can be checked by measuring viscoelasticity through a measuring method of viscosity at a constant shear rate with the use of a rotational viscometer for plastic or resin in a liquid state, an emulsion state, or a dispersion state (according to JIS K 7117-2).

When such a measurement is performed with respect to the surface of the coated paper having a surface layer of resin melted at a temperature close to the fixation temperature, a storage (elastic) modulus at 150° C. may preferably be not more than $1\times10^7$ Pa·s. The storage modulus may be considered that it is preferably be not more than $1\times10^6$ Pa·s.

However, when the coated paper has such a surface that it has a multi-layer structure, the above described viscoelasticity measurement cannot be performed in many cases. In other words, with respect to the outermost layer, even when 1-5 microns thick layer of resin having a storage modulus of $1\times10^7$ Pa·s. at 150° C. is coated on 10-50 microns thick layer of resin having a storage modulus of $1\times10^3$ Pa·s at 150° C., it is possible to attain such an effect that the resultant glossiness is changed and the toner is embedded. However, such an outermost layer functions as a plurality of layers as a whole. For this reason, it is difficult to represent the effect of the glossiness change and toner embedding by a combination of storage moduli of a single resin or a storage modulus of resin obtained by mixing plural resins. Further, it is very difficult to collect amounts of the resin, constituting the outermost layer of the ordinary coated paper, allowing the above described viscoelasticity measurement.

For these reasons, in this embodiment, the following discrimination method of (melt characteristic of) coated paper is employed. Hereinbelow, a discrimination method for discriminating between the ordinary coated paper having the surface layer which is not melted and the coated paper having the surface layer which is melted at a temperature close to the fixation temperature will be described.

First, coated paper is caused to enter the fixation apparatus and left in a fixation nip for 5 seconds to be sufficiently heated, and is then taken out thereof. Discrimination of coated paper is made by checking a state of the recording material (coated paper) surface (whether the resin is melted or not). More specifically, in the case where such a measurement is carried out, when the coated paper using the resin which is melted at the fixation temperature is used, the resin at the coated paper surface is melted and extruded from the fixation nip, so that a mark of the fixation nip is left as a stepwise (step height) portion. Accordingly, discrimination of coated paper can be performed by presence/absence of this stepwise portion. At this stepwise portion, the resin is protruded on an upstream side of the recording material movement direction, so that the resin layer is swollen on the upstream side, becomes thinner at the fixation nip, and becomes somewhat smooth on a downstream side after passing through the fixation nip since the resin which is started to melt toward the downstream side is collapsed or flattened. The resultant step height varies depending on a thickness of the resin layer but may generally be approximately 1-10 microns.

On the other hand, as for the coated paper using the pigment coating layer which is not melted at a temperature close to the fixation temperature, there is substantially no stepwise portion and a moderate uneven portion is formed due to pressure application in the fixation nip. Further, in some cases, the pigment coating layer is changed in color by heating.

By the above described method, it is possible to make discrimination of the melt characteristic of coated paper used but the following method may also be applicable. For example, a metal bar which has a certain weight and is heated up to a temperature close to the fixation temperature (approximately 180° C.) is placed on the coated paper for a certain period of time and then is removed. Discrimination is made by observing whether or not there is a mark of the metal bar at the position where it is placed.

(Image Forming Method Depending on Gloss Mode)

Next, an image forming method depending on a gloss mode will be described more specifically.

As shown in FIG. 2, an ordinary operation speed (process speed) of an image forming apparatus in this embodiment is 200 mm/sec set as a fixation speed (rate) in a low gloss mode in which image formation is carried out on low gloss paper. In the case of medium gloss mode in which image formation is carried out on medium gloss paper, the fixation speed is set to 100 mm/sec. Further, in the case of high gloss mode in which image formation is carried out on high gloss paper.

By setting the fixation speed as described above, it becomes possible to obtain a toner image gloss corresponding to a gloss level of the recording material P used. Herein, the gloss means that the glossiness is less than 25, the medium gloss means that the glossiness is not less than 15 and is less than 25, and the high gloss means that the glossiness is not less than 25. However, these threshold values are those for plain paper as standard paper (having a basis weight of 80 g/m$^2$), thus being only as reference values. With respect to general recording material, these values should be regarded as a difference in sensors relative level.

In this embodiment, the above described image control is performed by automatically selecting an image forming condition depending on a glossiness detected by a recording material glossiness detection apparatus.

Incidentally, setting of an image forming mode depending on the glossiness of recording material used may be performed by a user who selectively provides instructions from a liquid crystal display portion as an operating portion (mode setting means). In this case, the image forming apparatus is constituted so as to effect a sequence of image formation by receiving a mode signal selectively instructed from the liquid crystal display portion in a CPU.

Here, the respective gloss modes and halftone image processing will be described.

Figure 9:
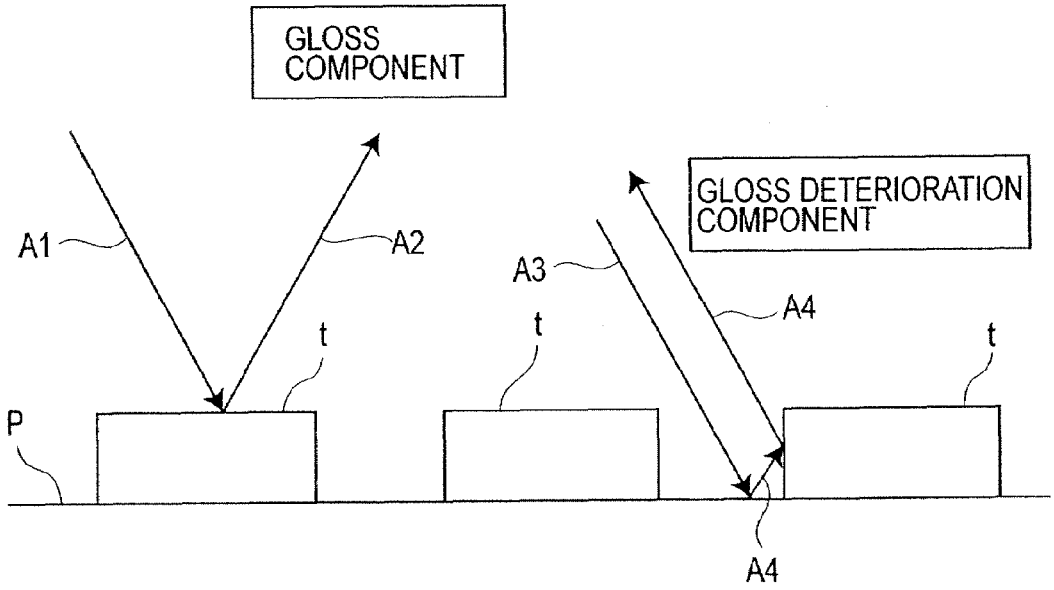
FIG. 9 is a view for illustrating such a state that a glossiness is lowered when a toner layer is stepwise formed (has a large thickness).
Figure 10:
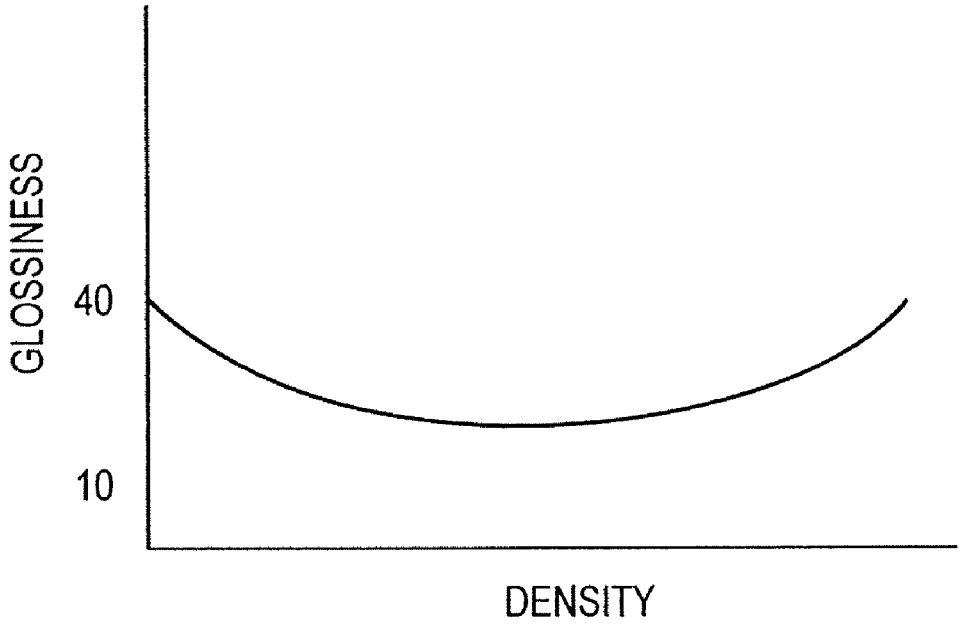
FIG. 10 is a graph showing a gloss characteristic in area coverage modulation when a toner layer has a stepwise portion.

An image formed in the low gloss mode is formed such that the toner layer is three-dimensionally formed on the recording material P as shown in FIG. 9, so that a gloss characteristic is suppressed to a lower level.

On the other hand, in the medium and high gloss modes, the gloss characteristic corresponds to that of the recording material, thus being flat irrespective of gradation area.

Figure 11:
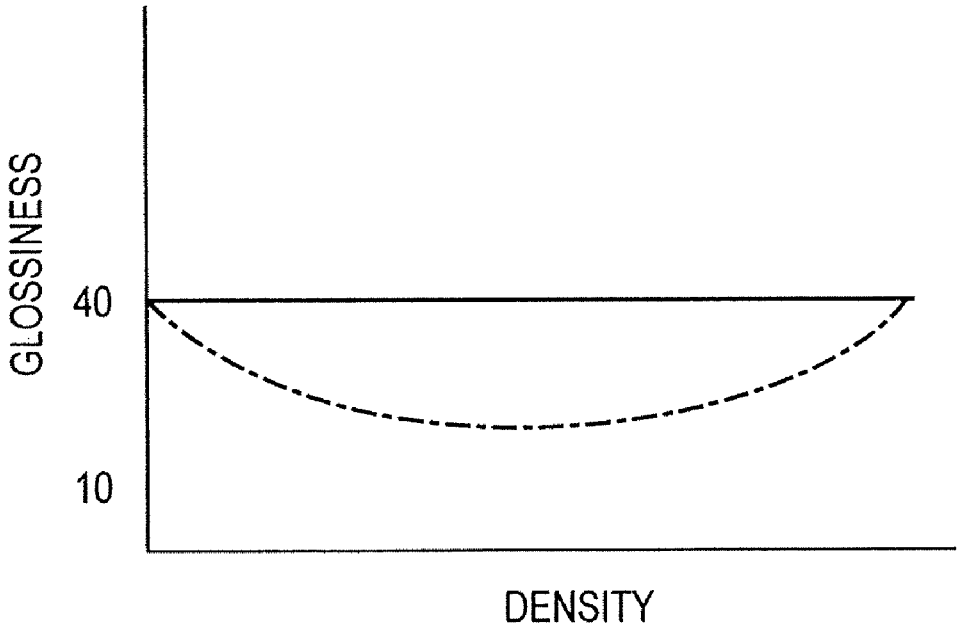
FIG. 11 is a graph showing a gloss characteristic in area coverage modulation when a toner layer is flattened or collapsed.
Figure 12:
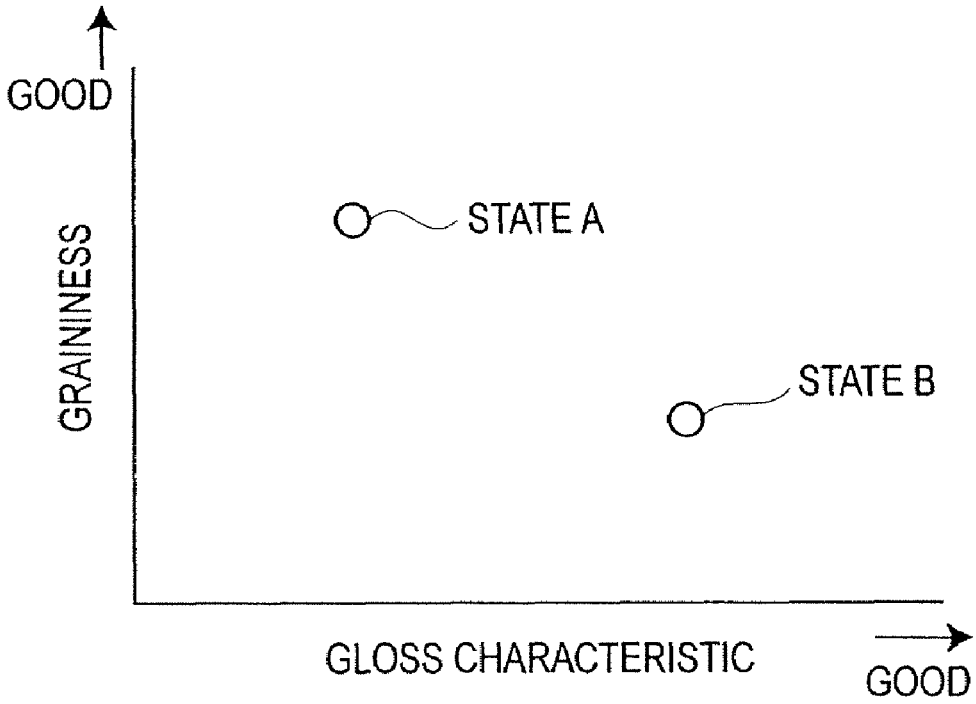
FIG. 12 is a graph showing a relationship between a gloss characteristic and a graininess in a state A in which a toner layer is flattened and a state B in which the toner layer is not flattened.
Figure 13:
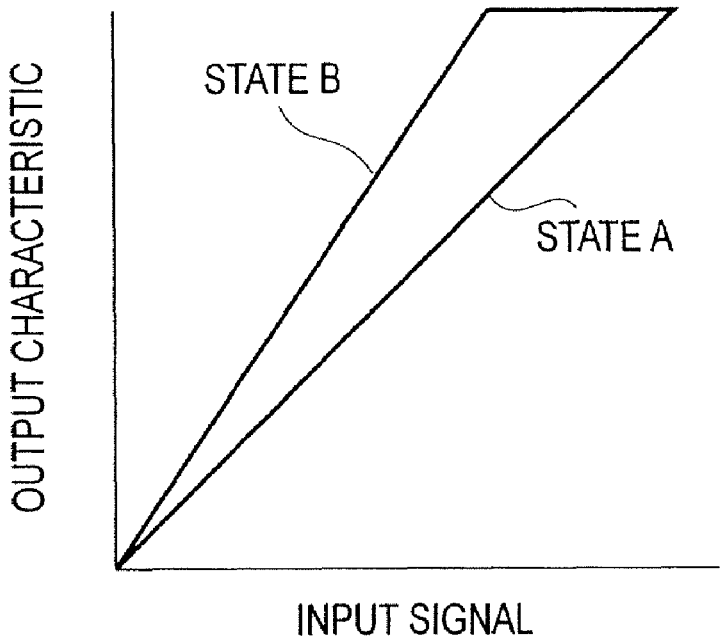
FIG. 13 is a graph showing γ characteristics in the state A and the state B.

The gloss characteristic in the high gloss mode is as shown in FIG. 11. In order to realize this gloss characteristic, fixation is carried out so as to collapse of toner image. Schematic cross sections of halftone toner images in the low, medium, and high gloss modes are shown in FIG. 14.

Figure 14:
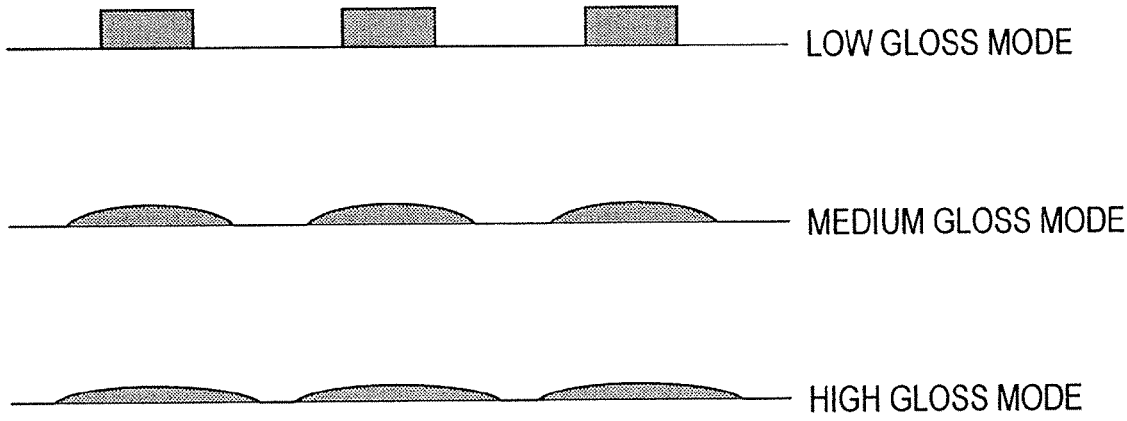
FIG. 14 includes views showing toner cross sections in a low gloss mode, a medium gloss mode, and a high gloss mode.

As shown in FIG. 14, the toner images are collapsed in the medium and high gloss modes to increase an areal hiding rate, thus causing such a problem that a so-called γ (gamma) characteristic is liable to rise.

A change in γ characteristic at a constant screen line number of 200 lpi (line per inch) when the fixation is performed by changing the fixation speed to 200 mm/sec, 100 mm/sec, and 70 mm/sec is shown in FIG. 3 wherein an abscissa represents an input image signal (256 gradation levels) and an ordinate represents an output image density. In FIG. 3, the γ characteristic at the fixation speed of 200 mm/sec is shown by taking a slope as 45 degrees. On the basis of this γ characteristic, the γ characteristic at the fixation speeds of 100 mm/sec and 70 mm/sec are relatively compared.

The change in γ characteristic is liable to manifest themself as deterioration in graininess since a minute fluctuation in height of the toner and/or a pressure distribution of the fixation apparatus before the toner image is collapsed manifests itself as a fluctuation in area of the toner image. This phenomenon is in close connection with the halftone image processing. As a line growth screen line number in an amplitude modulation (AM) scheme is larger, the phenomenon is liable to arise. Further, the phenomenon is more liable to arise in a frequency modulation (FM) scheme than the AM scheme. The relationship between the FM and AM schemes is dependent on detailed conditions but in the present invention, such a model that a pixel at 300 dpi FM is not connected until a duty ratio is 50%, is assumed. The tendency is in close connection with a total peripheral length of pixels constituting the toner image. This is because when the toner image is collapsed, the toner is extended from an end portion of pixel in a horizontal direction, so that the toner image is liable to be collapsed with a longer length of the end portion, i.e., a longer peripheral length.

Figure 16:
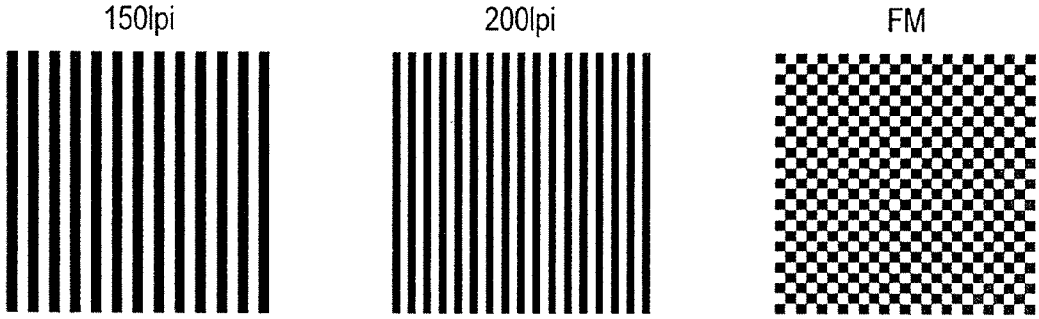
FIG. 16 includes views showing pixels structures at image ratio of 50% in assumed models of AM 150 lpi, AM 200 lpi, and FM.

Here, as shown in FIG. 16, the AM scheme refers to such a halftone (image) processing that gradation representation is effected by changing a line width without changing an spatial frequency of pixel structure. Further, the FM scheme refers to such a halftone processing that gradation representation is effected by changing a spatial frequency characteristic (the number of dots) as represented by error diffusion. For example, in the case where a dot matrix of 5×5 pixels is considered, the AM scheme is such a scheme that gradation is represented by increasing a pixel (exposure portion) adjacent to a certain pixel (exposure portion), and the FM scheme is such a scheme that gradation is represented by increasing a pixel (exposure portion) which is not adjusted to a certain pixel (exposure portion). These modulation schemes may be realized through dither method or the like.

Figure 15:
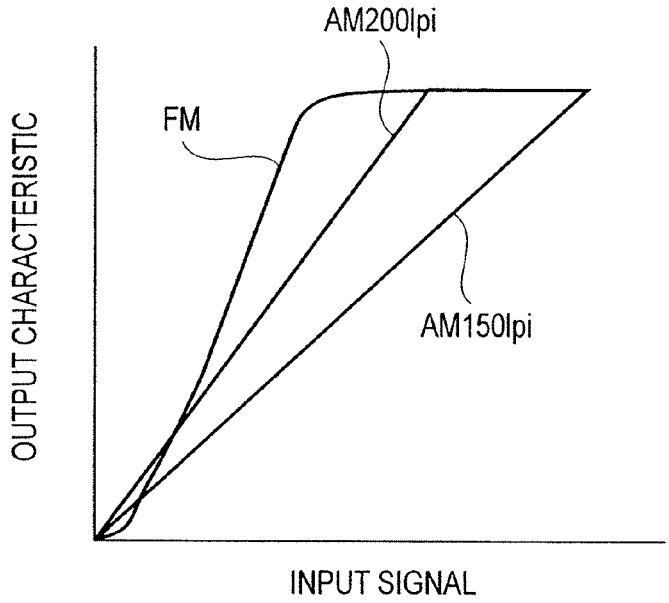
FIG. 15 is a graph showing a relationship between a peripheral length and a difference in screen line number in amplitude modulation (AM) or a difference between AM and frequency modulation (FM).

How the difference in screen line number by the AM scheme and the difference between the AM scheme and the FM scheme is in connection with the peripheral length, i.e., the γ characteristic depending on the scheme is shown in FIG. 15 wherein an abscissa represents an input image signal (256 gradation levels) and an ordinate represents an output image density.

FIG. 16 shows pixel structures at an image ratio of 50% of assumed models of line growth AM 150 lip, line growth 200 lip, and FM (300 dpi (dot per inch)). Further, FIG. 4 shows a change in γ characteristic when the fixation is carried out at a constant fixation speed of 70 mm/sec by changing the screen line number to FM (300 dpi), line growth AM 200 lpi, and line growth AM 150 lpi. In this case, the γ characteristic at the line growth AM 150 lpi is shown in FIG. 4 while taking a slope as 45 degrees. On the basis of the γ characteristic, the γ characteristics at the FM (300 dpi) and the line growth AM 150 lpi are relatively compared. Incidentally, both in FIGS. 3 and 4, the respective γ characteristics are approximated as (straight) lines. As is apparent from FIG. 15, the peripheral length is increased in almost all halftone areas with an increasing screen line number in the order of the line growth AM 150 lip, the line growth AM 200 lpi, and the FM (300 dpi).

Accordingly, in this embodiment, the FM (300 dpi) for the low gloss mode, the line growth AM 200 lpi for the medium gloss mode, and the line growth AM 150 lpi for the high gloss mode are employed.

Figure 6:
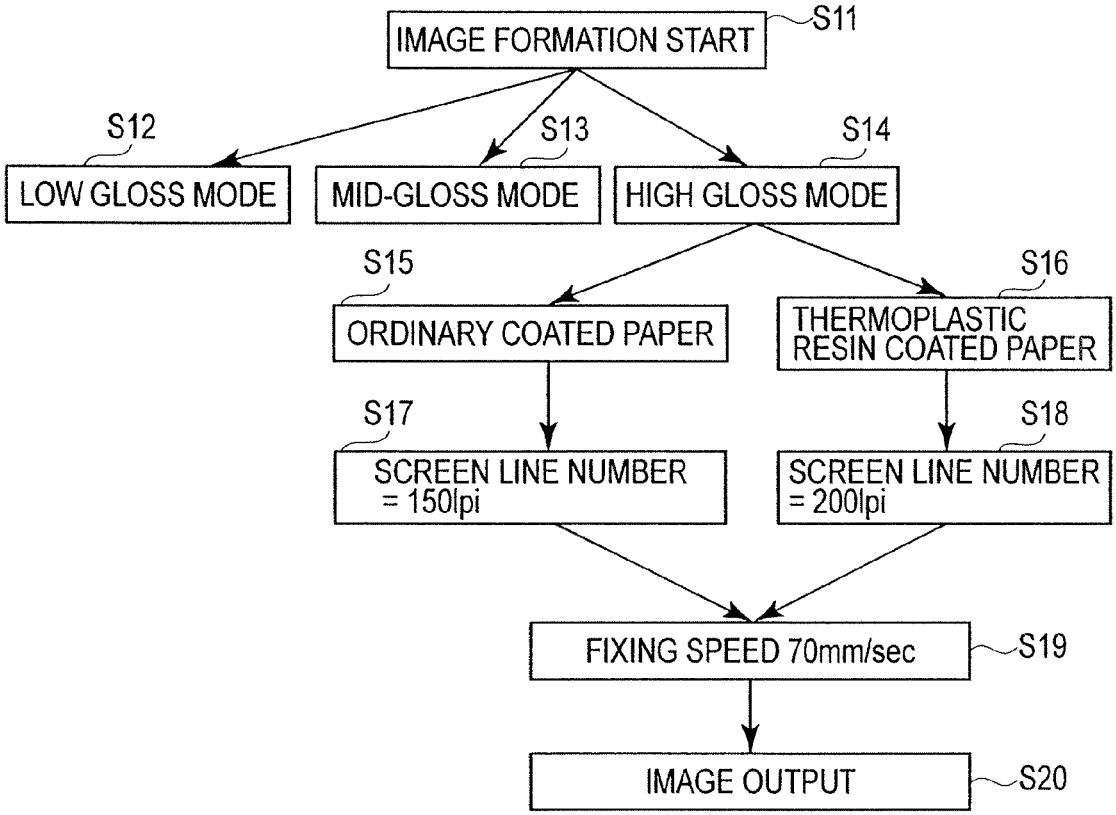
FIGS. 6 and 7 are flow charts each showing flow of control.

Further, in this embodiment, the image forming condition in the high gloss mode is switched as shown in a flow chart of FIG. 6.

Referring to FIG. 6, when image formation is started (S11), the glossiness of the recording material P subjected to the image formation is detected by the recording material glossiness detection apparatuses 71, 72, 73 and 74 (FIG. 1). Depending on the detected glossiness, the low gloss mode, the medium gloss mode, and the high gloss mode are automatically switched by the CPU (FIG. 1) as the control means (S12, S13, S14). Incidentally, as described above, in place of the automatic switching, the user may also manually switch the gloss mode. In this case, the discrimination means corresponds to, e.g., a mode selection screen displayed on the operation panel of the image forming apparatus.

Figure 17:
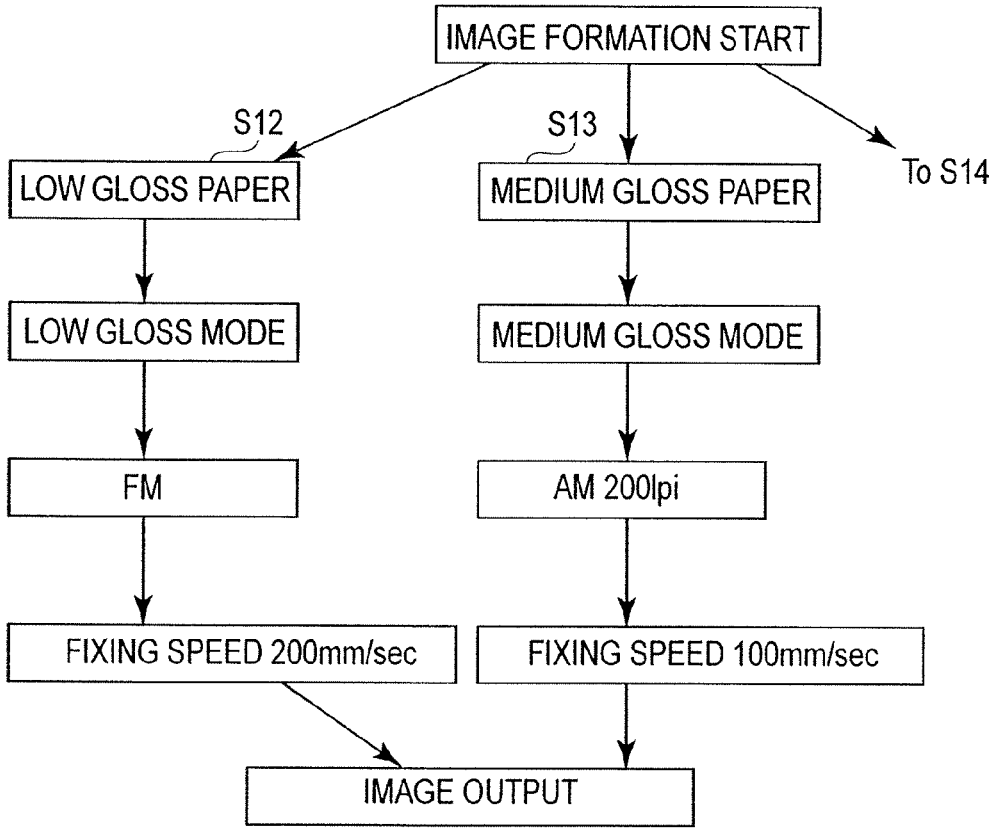
FIG. 17 is a flow chart showing flow of control.

Incidentally, in the low and medium gloss modes, the above described phenomenon that the γ characteristic rises is less liable to occur. For this reason, as shown in FIG. 17, halftone processing is carried out at the screen line number of AM 200 lpi in the medium gloss mode and of FM (300 dpi) in the low gloss mode. The fixation speed is set to 200 mm/sec in the low gloss mode and 100 mm/sec in the medium gloss mode.

In the high gloss mode, the halftone processing is changed depending on whether the recording material P is the ordinary coated paper or the thermoplastic resin coated paper. More specifically, as shown in FIG. 6, the screen line number is set to about 150 lpi (S17) for the ordinary coated paper (S15) and 200 lpi (S18) for the thermoplastic resin coated paper (S16). The fixation speed is set to 70 mm/sec for both the ordinary coated paper and the thermoplastic resin coated paper (S19). Under these conditions, the toner image is formed on the recording material P, subjected to the fixation treatment, and is outputted as an image (S20).

As described above, at the time when gloss reproduction corresponding to the glossiness of the recording material is made in the high gloss mode, an optimum halftone processing (optimum screen line number) is selected depending on the kind of high gloss coated paper. In other words, the halftone processing is employed so as to provide a longer peripheral length in the low gloss mode and a shorter peripheral length in the higher gloss mode, whereby it is possible to obviate unstability due to rise in γ characteristic and deterioration in graininess. As a result, it becomes possible to optimize the gloss characteristic and other image characteristics.

More specifically, in the ordinary coated paper, it is possible to obviate the rise in γ characteristic, deterioration in graininess, character collapse, etc. On the other hand, in the thermoplastic resin coated paper, it becomes possible to obtain a high-quality image having a characteristic comparable to that of silver halide photography by the increase in screen line number, the error diffusion, and the improvement in maximum density.

Embodiment 2

In this embodiment, the toner coverage in the high gloss mode is changed depending on whether the recording material P is the ordinary coated paper or the thermoplastic resin coated paper. Incidentally, the image forming apparatus used in this embodiment is the same as that used in Embodiment 1 described above, thus being omitted from the general explanation thereof.

As described above, in the case where the fixation speed is low when the toner image is fixed on the ordinary high gloss coated paper, the toner layer is collapsed at the time of fixation and is extended in a horizontal direction. As a result, there arises such a problem that rise in γ characteristic and character collapse are liable to occur. On the other hand, the thermoplastic resin coated paper has the toner receptive layer, so that such a problem is less liable to occur.

Figure 7:
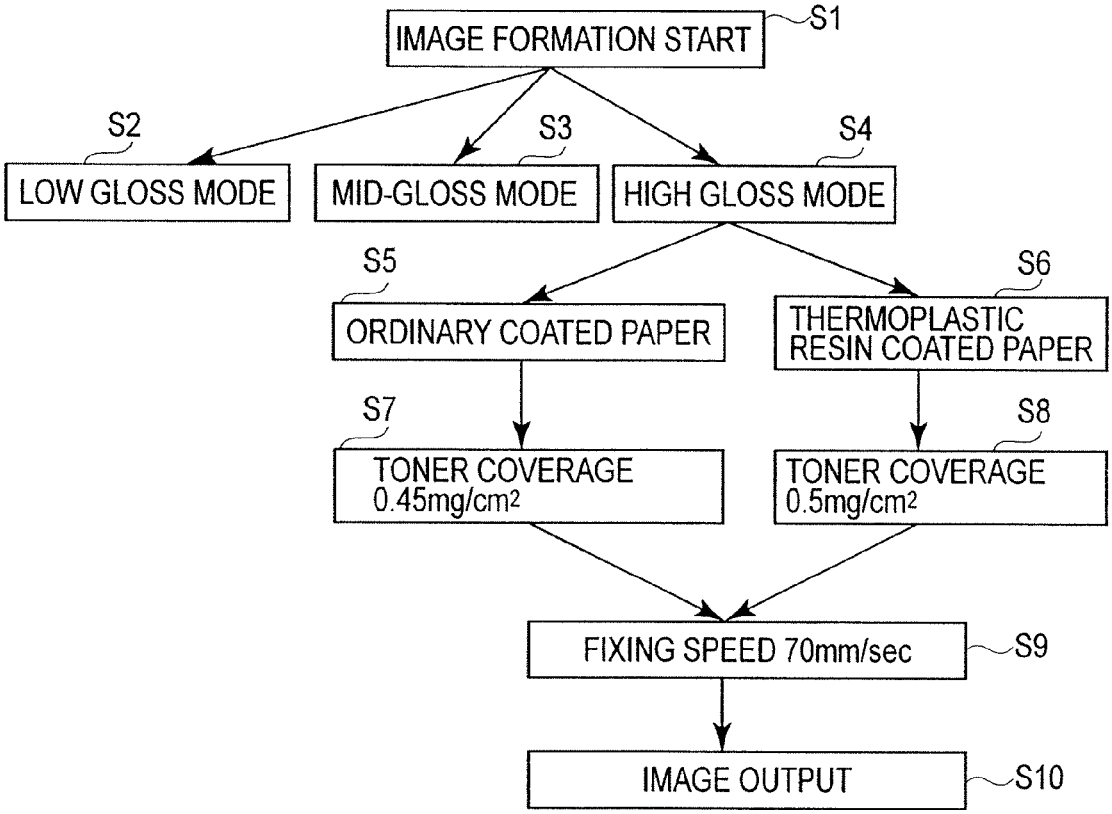

Accordingly, in this embodiment, a toner coverage in the high gloss mode is switched between the ordinary high gloss coated paper and the thermoplastic resin coated paper. Hereinbelow, such a switching operation will be described along a flow chart shown in FIG. 7.

Referring to FIG. 6, when image formation is started (S1), the glossiness of the recording material P subjected to the image formation is detected by the recording material glossiness detection apparatuses 71, 72, 73 and 74 (FIG. 1). Depending on the detected glossiness, the low gloss mode, the medium gloss mode, and the high gloss mode are automatically switched by the CPU (FIG. 1) as the control means (S2, S3, S4). Incidentally, as described above, in place of the automatic switching, the user may also manually switch the gloss mode.

Incidentally, in the case where the low gloss mode or the medium gloss mode is selected, the phenomenon that the γ characteristic rises is less liable to occur as described above. For this reason, only in the case where the high gloss mode is selected, image formation is carried out under the following image forming condition.

In the high gloss mode, the user inputs information on whether the recording material P is the ordinary high gloss coated paper (S5) or the thermoplastic resin coated paper (S6), so that the image forming condition is switched depending on the information. In this embodiment, the image forming condition is a toner coverage for each color.

A change in toner coverage is performed by changing setting of developing contrast during development.

Figure 8:
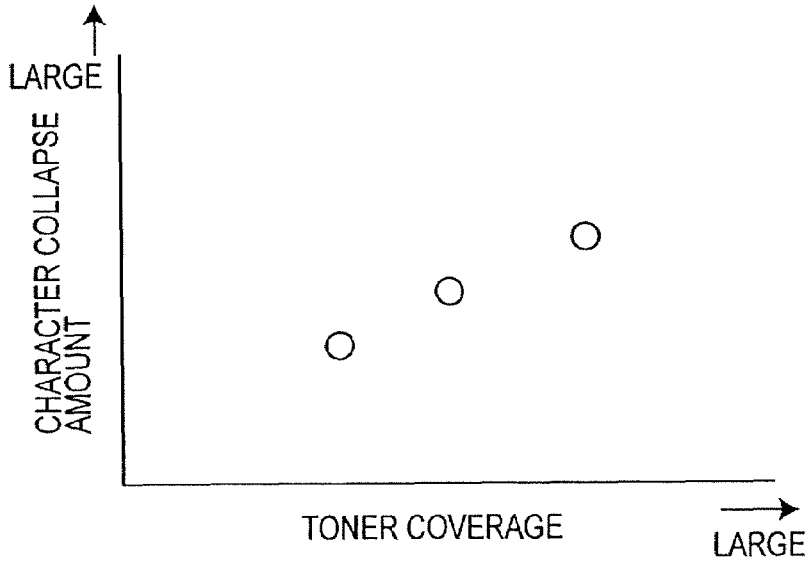
FIG. 8 is a graph showing a relationship between a toner coverage (amount of toner) and an amount of character collapse with respect to ordinary high gloss coated paper.

FIG. 8 shows a relationship between a toner coverage (toner layer height) and a character collapse amount with respect to the ordinary high gloss coated paper in the high gloss mode. As shown in FIG. 8, as the toner coverage is increased (the toner layer is higher), the character collapse amount in the high gloss mode is increased. Accordingly, with respect to the ordinary high gloss coated paper, the toner coverage may preferably be decreased (the toner layer height is lowered) compared with the case of the thermoplastic resin coated paper.

When the toner coverage is decreased, there is a problem that a maximum image density is lowered. In this embodiment, a maximum value of the toner coverage is 0.5 mg/cm$^2$ in the case of the high-quality paper being the low gloss paper. In this case, the resultant maximum (image) density is 1.6. When the image formation is performed on the ordinary high gloss coated paper at the same toner coverage, the maximum density is generally liable to be increased. When the image formation is performed in the same high gloss mode, the maximum density is 1.9.

For this reason, in this embodiment, in the case of forming an image on the ordinary high gloss coated paper in the high gloss mode, the maximum value of the toner coverage is set to 0.45 mg/cm$^2$ (S7) so as to provide the same maximum density of 1.6 as in the case of the high-quality paper. As a result, it becomes possible to obviate the problem of character collapse on the ordinary high gloss coated paper.

Further, in the case of the high gloss mode using the thermoplastic resin coated paper, the character collapse problem is less liable to arise, so that the maximum value of the toner coverage is increased compared with the ordinary high gloss coated paper to increase the maximum density. As a result, it becomes possible to output a high-quality image with a wide reproduction range of the image density.

In this embodiment, when the thermoplastic resin coated paper is used, the maximum value of the toner coverage is set to 0.5 mg/cm$^2$ (S8), so that the maximum density is 1.9. As a result, it is possible to obtain an image contrast close to that of the silver halide photograph.

In any case of the ordinary high gloss coated paper and the thermoplastic resin coated paper, image output is performed by setting the fixation speed to 70 mm/sec (S10).

As described above, according to this embodiment, by switching the toner coverage between the ordinary high gloss coated paper and the thermoplastic resin coated paper, it is possible to not only obviate the character collapse problem and the like but also permit output of an optimum quality image on the respective recording materials P by controlling the maximum density.

Embodiment 3

An image forming apparatus used in this embodiment has the same constitution as in Embodiments 1 and 2 except that a fixation apparatus different in constitution from those in Embodiments 1 and 2, thus being omitted from repetitive explanation.

Figure 18:
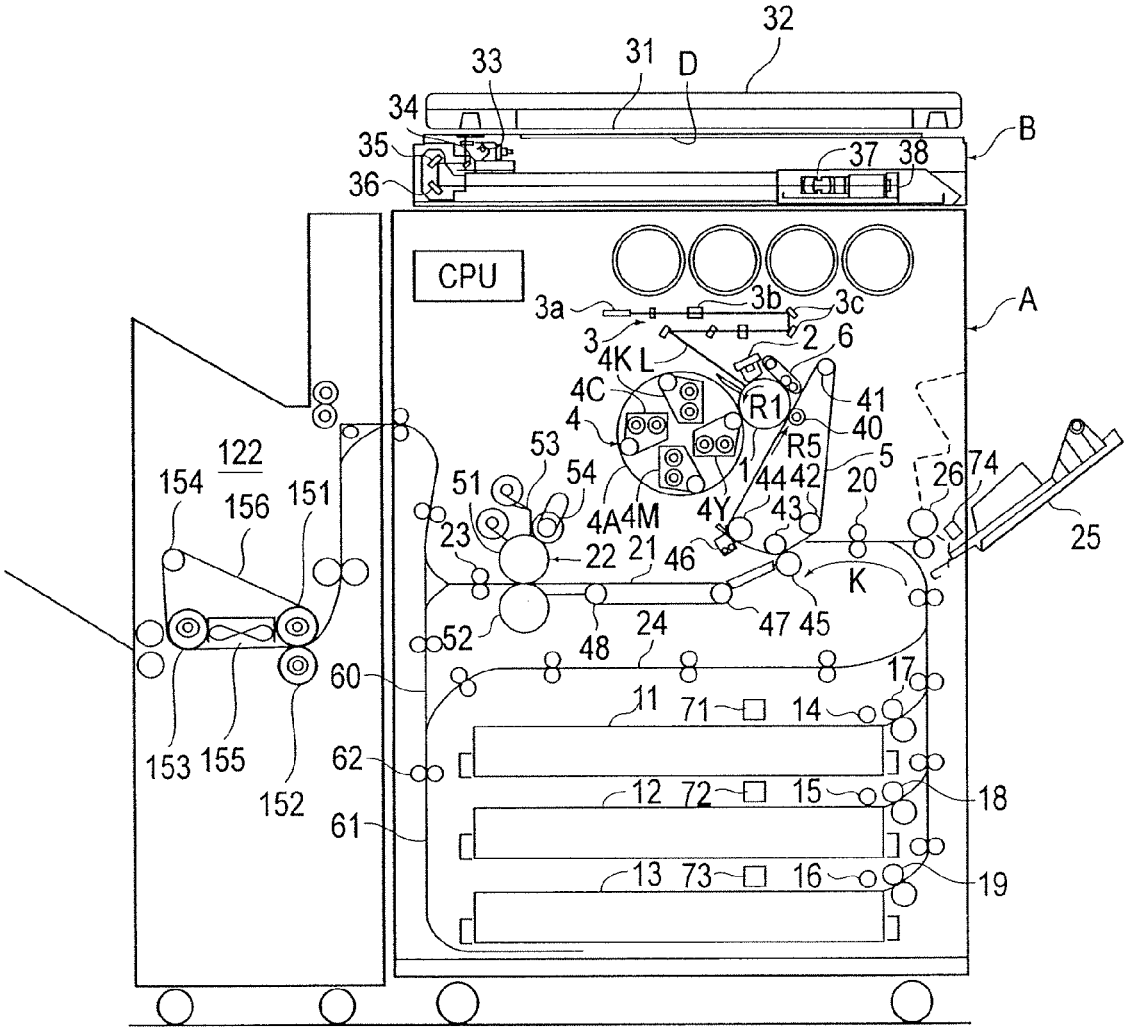
FIG. 18 is a schematic longitudinal sectional view of an image forming apparatus.

The image forming apparatus in this embodiment is shown in FIG. 18. Referring to FIG. 18, at the paper discharge (output) portion of the image forming apparatus (described with reference to FIG. 1), an option unit provided with a fixation apparatus 122 for the thermoplastic resin coated paper is detachably mounted. More specifically, in the image forming apparatus shown in FIG. 18, two fixation apparatuses including the fixation apparatus 22 as a first image heating means and the fixation apparatus 122 as a second image heating means are mounted.

(Option Unit)

The option unit will be described in detail.

The option unit includes the fixation apparatus 122 and a guide for switching a conveyance mode as to whether the recording material subjected to the fixation treatment in the fixation apparatus 22 is conveyed as it is toward the discharge tray disposed on an upper surface of the option unit or conveyed toward the fixation apparatus 122 to be discharged therethrough. Further, the option unit includes the above mentioned discharge tray disposed on the upper surface, a discharge tray disposed on a side surface (where the recording material subjected to fixation treatment in the fixation apparatus is mounted), and a plurality of roller pair, for conveying the recording material toward the discharge trays and the fixation apparatus 122, disposed at appropriate positions.

The fixation apparatus 122 includes a fixation roller 151, a pressure roller 152, a separation roller 153, a tension roller 154, a cooling fan 155, and a fixation belt 156. Further, the fixation apparatus 122 includes heaters (halogen lamps) in the fixation roller 151 and the pressure roller 152, respectively. Energization of the respective heaters is controlled depending on a detection result of temperature of the fixation roller 151 and the pressure roller 152.

The fixation roller 151 has a concentrical three-layer structure including a core portion, an elastic layer, and a release layer. The core portion is formed of a hollow aluminum pipe having a diameter of 44 mm and a thickness of 5 mm. The elastic layer is constituted by a 300 micron-thick silicone rubber having a JIS-A hardness of 50 degrees, and the release layer is constituted by a 50 micron-thick PFA layer. Inside the hollow core portion, a halogen lamp as a heat source is disposed.

The pressure roller 152 has the same constitution as the fixation roller 151 except that the elastic layer is constituted by a 3 mm-thick silicone rubber layer so as to ensure a fixation nip by the elastic layer.

A pressing force of the pressure roller 152 against the fixation roller 151 is set to 50 kg in total, and a length of the fixation nip in a recording material conveyance direction is set to 5 mm.

The separation roller 153 and the tension roller 154 are constituted by an aluminum-mode hollow pipe.

Further, in an area extending from the fixation roller 151 to the separation roller 153, the cooling fan 155 as a cooling mean for cooling the recording material hermetically held on the fixation belt 156 is disposed. The cooling fan 155 cools the recording material to be readily peeled from the fixation belt 156, thus preventing failure in conveyance of the recording material.

Further, air flow in a direction perpendicular to the drawing face of FIG. 18 is generated by the cooling fan 155. In the present invention, as the cooling means, other than the cooling fan 155, it is also possible to use a circulation-type cooling apparatus, comprising Peltier device, a heat pipe, and water, which contacts and cools the fixation belt 156.

Further, the fixation belt 156 is supplied with a predetermined tension by the tension roller 154. The fixation belt 156 is rotated by the rotation of the fixation roller 151 in a clockwise direction.

Next, a fixation operation of the fixation apparatus 122 will be explained.

A CPU supplies electric power to the halogen lamps contained in the fixation and pressure rollers 151 and 152 to control surface temperatures of the rollers so that they are increased and kept at a predetermined fixation temperature (close to 180° C.).

When the surface temperatures of the fixation roller 151 and the pressure roller 152 reach the fixation temperature, the recording material P on which the toner image is formed enters the fixation nip as an abutting portion between the fixation belt 156 and the pressure roller 152. At that time, the temperature of the transparent resin is increased and the resin is softened together with the toner. In addition, a pressure is exerted on the toner image by the fixation roller 151 and the pressure roller 152, whereby the toner image is embedded in the transparent resin layer. The recording material P on which the toner image is embedded in the transparent resin layer is conveyed to a separation portion of the separation roller 153 while being hermetically held on the surface of the fixation belt 156.

During a period in which the recording material P placed in a state of contacting hermetically the fixation belt 156 is conveyed to the separation portion, the recording material P is forcedly cooled efficiently by the cooling fan 155 (to a temperature (about 50-60° C.) lower than a softening point of the toner).

Then, after the recording material P hermetically held on the surface of the fixation belt 156 is sufficiently cooled in the cooling area, the recording material P is separated from the fixation belt 156 by its own stiffness (rigidity) at the separation portion where a curvature of the fixation belt 156 is changed by the separation roller 153. Accordingly, a recording material separation temperature of the fixation apparatus 122 is lower than that of the fixation apparatus 22.

By effecting the separation under cooling as described above, it becomes possible to finish the recording material surface so as to substantially correspond to the fixation belt surface to a state free from unevenness.

Accordingly, according to this embodiment, it is possible to provide a high-quality image having a glossiness comparable to that of the silver halide photography by using the fixation apparatus 122.

(Image Forming Method Depending on Gloss Mode)

Figure 19:
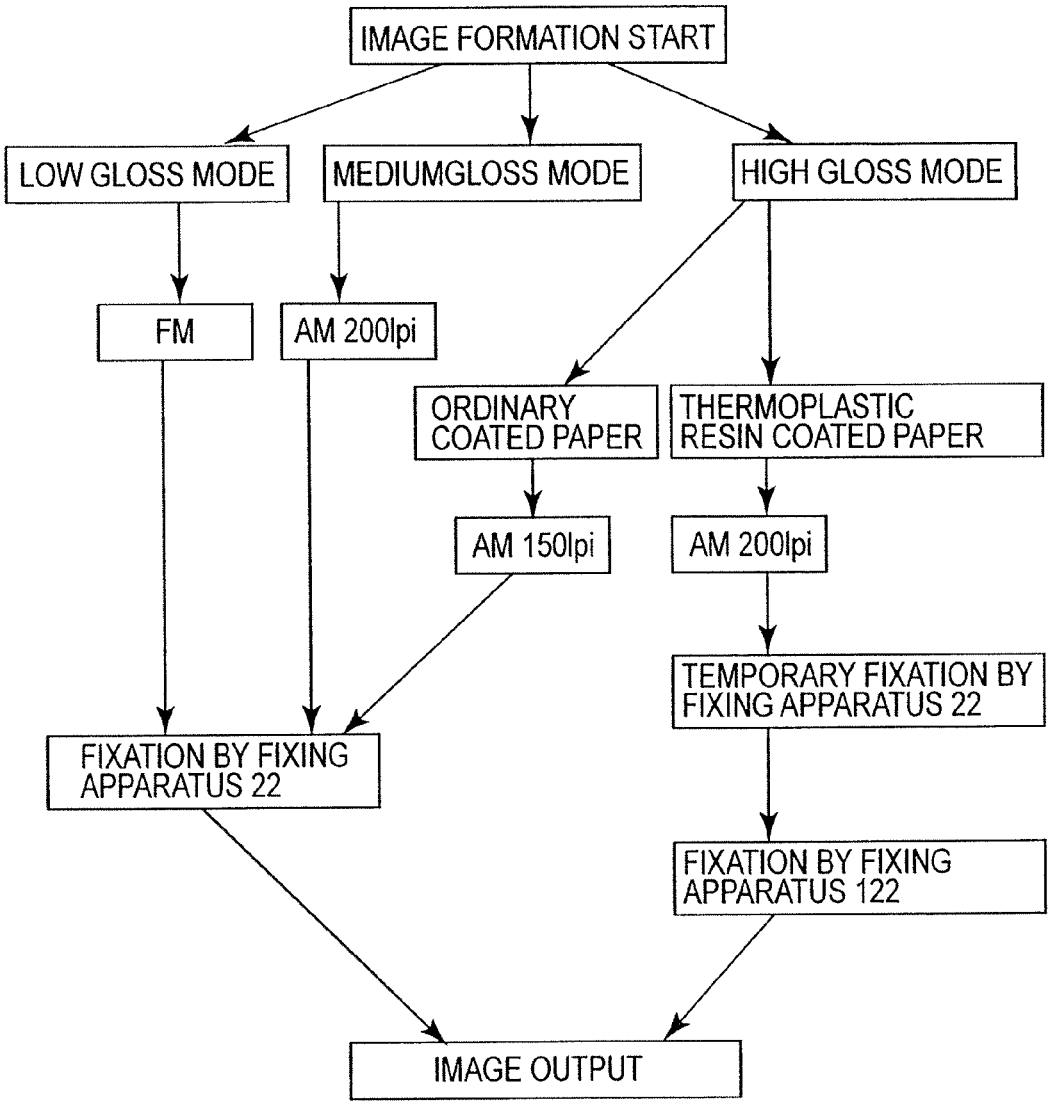
FIG. 19 is a flow chart showing flow of control.

Next, an image forming method depending on a gloss mode will be described more specifically with reference to FIG. 19.

First, the high gloss mode in which an image is formed on the above described ordinary high gloss coated paper or thermoplastic resin coated paper will be explained.

In this embodiment, depending on the recording material used in the high gloss mode, an image formation mode is switched between one using only the fixation apparatus 22 and one using both the fixation apparatus 22 and the fixation apparatus 122. This switching is carried out by the user by selectively instructing the kind of the coated paper to be used at the operating portion.

More specifically, when the user presses a button of the operating portion where "photographic mode" is displayed, the CPU recognizes that the kind of the recording material is the thermoplastic resin coated paper to set an image forming condition in which the fixation treatment is carried out by using both of the fixation apparatus 22 and the fixation apparatus 122.

On the other hand, when the user presses a button of the operation portion where any one of "low gloss mode", "medium gloss mode", and "high gloss mode" is displayed, the CPU recognizes that the kind of the coated paper is corresponding coated paper of the above described low gloss paper, medium gloss paper, and high gloss paper to switch an image forming mode in which the fixation treatment is carried out by using only the fixation apparatus 22.

The names of the buttons of the operating portion are not limited to those mentioned above but may be any ones so long as they suitably represents the kind of the recording material used.

The flows in the low gloss mode and the medium gloss mode are the same as those described in Embodiment 1. On the other hand, a flow in the high gloss mode in this embodiment is changed depending on the fixation apparatus (es) used.

More specifically, in the case of using only the fixation apparatus 22 (for the ordinary high gloss coated paper), the screen line number is set to AM 150 lpi, at which image formation is performed.

On the other hand, in the case of using both of the fixation apparatuses 22 and 122 (for the thermoplastic resin coated paper), the screen line number is set to AM 200 lpi, at which image formation is performed.

Incidentally, the fixation speed in the high gloss mode is set to 70 mm/sec in either of the above two cases.

In this embodiment, other than the above described switching of the screen line number, similarly as in Embodiment 2, it is possible to adopt such a constitution that a (maximum) toner coverage of the ordinary high gloss coated paper is lower than that of the toner coverage coated paper.

Incidentally, in the above described Embodiments 1 to 3, such a constitution that the selection of the image forming mode by the user is performed at the operating portion of the image forming apparatus is described but it is also possible to employ, e.g., such a constitution that selection and instruction of the image forming mode are made from a host computer, such as a personal computer (PC) or the like, connected to the image forming apparatus through a LAN cable. In this case, when an interface which is disposed in the image forming apparatus as an input means receives a signal for indicating the image forming mode from the PC, the CPU sets various image forming conditions (the screen line number, the toner coverage, etc.) depending on the inputted signal.

As described above, by switching the various image forming conditions (the screen line number, the toner coverage, etc.) for forming an image on the recording material depending on the (number of) fixation apparatus(es) used, a lowering in image quality can be prevented while improving the glossiness of the image.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 096921/2002 filed Mar. 29, 2004 and 087109/2005 filed Mar. 24, 2005, which are hereby incorporated by reference.

What is claimed is:

1. An image forming apparatus, comprising:

an image formation device configured and positioned to form a toner image on a recording material;

a first image heating device configured and positioned to heat the toner image on the recording material;

a second image heating device, disposed at downstream side of said first image heating device in a conveying direction of the recording material, configured to heat the toner image on the recording material heated by said first image heating device;

a selecting device configured and positioned to select one of high gloss modes including a first high gloss mode for performing image heating process only by said first image heating device and a second high gloss mode for performing image heating process by said first image heating device and said second image heating device; and a controlling device configured and positioned to control an image forming condition of said image formation device so that a maximum amount of toner per unit area in the first high gloss mode is smaller than that in the second high gloss mode.

2. An apparatus according to claim 1, wherein a temperature that the recording material is separated from said first image heating device is higher than a temperature that the recording material is separated from said second image heating device.

3. An apparatus according to claim 1, wherein said second image heating device comprises a belt, disposed on a side where it contacts the toner image on the recording material, which heats the toner image on the recording material, a nip forming member, which forms a nip with said belt cooperatively, and a cooling device which cools the recording material, before separation, placed in a state of contact with said belt.

4. An apparatus according to claim 1, wherein when a recording material provided at its surface with a resin coated layer having a characteristic that the layer is softened by heat from said second image heating device is used, said selecting device selects the second high gloss mode.

5. An image forming apparatus, comprising:

an image formation device configured and positioned to form a toner image on a recording material;

a first image heating device configured and positioned to heat the toner image on the recording material; and a second image heating device, disposed at downstream side of said first image heating device in a conveying direction of the recording material, configured to heat the toner image on the recording material heated by said first image heating device;

a selecting device configured and positioned to select one of high gloss modes including a first high gloss mode for performing an image heating process only by said first image heating device and a second high gloss mode for performing an image heating process by said first image heating device and said second image heating device; and a controlling device configured and positioned to control an image forming condition of said image forming device so that a screen line number in the first high gloss mode is smaller than that in the second high gloss mode.

6. An apparatus according to claim 5, wherein a temperature that the recording material is separated from said first image heating device is higher than a temperature that the recording material is separated from said second image heating device.

7. An apparatus according to claim 5, wherein said second image heating device further comprising:

a belt, disposed on a side where it contacts the toner image on the recording material, which heats the toner image on the recording material;

a nip forming member, which forms a nip with said belt cooperatively; and a cooling device which cools the recording material, before separation, placed in a state of contact with said belt.

8. An apparatus according to claim 5, wherein when a recording material provided at its surface with a resin coated layer having a characteristic that the layer is softened by heat from said second image heating device is used, said selecting device selects the second high gloss mode.

* * * * *

UNITED STATES PATENT AND TRADEMARK OFFICE

CERTIFICATE OF CORRECTION

PATENT NO. : 7,340,190 B2
APPLICATION NO. : 11/694047
DATED : March 4, 2008
INVENTOR(S) : Toyohara et al.

It is certified that error appears in the above-identified patent and that said Letters Patent is hereby corrected as shown below:

IN THE DRAWINGS:
Sheet No. 13, Figure 19, "MEDIUMGLOSS MODE" should read --MEDIUM GLOSS MODE--.

COLUMN 1:
Line 55, "characteristics" should read --characteristic--.

COLUMN 2:
Line 1, "above described" should read --above-described--; and "worsen." should read --worsened.--.
Line 11, "nonuniform" should read --a nonuniform--.
Line 25, "but" should read --except for--.

COLUMN 4:
Line 23, "above structured" should read --above-structured--.
Line 61, "an" should read --a--.

COLUMN 5:
Line 11, "above described" should read --above-described--.
Lines 61 to 67 should be deleted.

COLUMN 6:
Line 16, "above" should read --above- --.
Line 42, "above" should read --above- --.
Line 46, "above described" should read --above-described--.
Line 52, "above described" should read --above-described--.
Line 55, "However 3," should read --However,--.

COLUMN 7:
Line 57, "above described" should read --above-described--.

COLUMN 8:
Line 50, "selected" should read --be selected--.

COLUMN 9:
Line 5, "carl" should read --curl--.

UNITED STATES PATENT AND TRADEMARK OFFICE

CERTIFICATE OF CORRECTION

PATENT NO. : 7,340,190 B2
APPLICATION NO. : 11/694047
DATED : March 4, 2008
INVENTOR(S) : Toyohara et al.

It is certified that error appears in the above-identified patent and that said Letters Patent is hereby corrected as shown below:

COLUMN 10:
Line 3, “surface” should read --surfaces--.
Line 4, “above described” should read --above-described--.
Line 31, “above described” should read --above-described--.
Line 32, “above described” should read --above-described--.
Line 52, “above described” should read --above-described--.

COLUMN 11:
Line 8, “above described” should read --above-described--.
Line 23, “above described” should read --above-described--.
Line 61, “above described” should read --above-described--.

COLUMN 12:
Line 26, “above described” should read --above-described--.

COLUMN 13:
Line 1, “them-” should read --it--.
Line 23, “an” should read --a--.
Line 44, “150 lip,” should read --150 lpi,--.
Line 45, “200 lip,” should read --200 lpi,--.
Line 58, “150 lip,” should read --150 lpi,--.

COLUMN 14:
Line 14, “above described” should read --above-described--.

COLUMN 15:
Line 7, “along” should read --along with--.

COLUMN 16:
Line 18, “that” should read --for--.
Line 41, “above mentioned” should read --above-mentioned--.
Line 44, “pair,” should read --pairs,--.

COLUMN 17:
Line 12, “mean” should read --means--.

UNITED STATES PATENT AND TRADEMARK OFFICE

CERTIFICATE OF CORRECTION

PATENT NO. : 7,340,190 B2
APPLICATION NO. : 11/694047
DATED : March 4, 2008
INVENTOR(S) : Toyohara et al.

It is certified that error appears in the above-identified patent and that said Letters Patent is hereby corrected as shown below:

COLUMN 18:
Line 10, “above described” should read --above-described--.
Line 30, “above described” should read --above-described--.
Line 36, “represents” should read --represent--.
Line 54, “above described” should read --above-described--.
Line 59, “above described” should read --above-described--.

COLUMN 19:
Line 50, “comprises” should read --comprises:--.

COLUMN 20:
Line 39, “comprising” should read --comprises:--.

Signed and Sealed this

Twenty-fifth Day of November, 2008

JON W. DUDAS
*Director of the United States Patent and Trademark Office*